US011568788B2

(12) United States Patent
Hei et al.

(10) Patent No.: US 11,568,788 B2
(45) Date of Patent: Jan. 31, 2023

(54) DISPLAY DRIVING METHOD, DISPLAY DRIVER, AND DISPLAY DEVICE

(71) Applicant: WUHAN TIANMA MICROELECTRONICS CO., LTD., Wuhan (CN)

(72) Inventors: Yajun Hei, Wuhan (CN); Guang Wang, Wuhan (CN); Jingxiong Zhou, Wuhan (CN)

(73) Assignee: WUHAN TIANMA MICROELECTRONICS CO., LTD., Wuhan (CN)

( * ) Notice: Subject to any disclaimer, the term of this patent is extended or adjusted under 35 U.S.C. 154(b) by 0 days.

(21) Appl. No.: 17/656,652

(22) Filed: Mar. 28, 2022

(65) Prior Publication Data

US 2022/0215790 A1 Jul. 7, 2022

(30) Foreign Application Priority Data

Dec. 29, 2021 (CN) ..... 202111639898.3

(51) Int. Cl.
*G09G 3/20* (2006.01)
*G09G 3/3208* (2016.01)

(52) U.S. Cl.
CPC ..... *G09G 3/2074* (2013.01); *G09G 3/3208* (2013.01); *G09G 2320/0233* (2013.01); *G09G 2320/0693* (2013.01)

(58) Field of Classification Search
CPC ..... G09G 3/20; G09G 3/2007; G09G 3/2074; G09G 3/3208; G09G 3/3607; G09G 3/006; G09G 2300/0443; G09G 2320/0233; G09G 2320/0242; G09G 2320/0271; G09G 2320/0276; G09G 2320/0285; G09G 2320/0295; G09G 2320/0673; G09G 2320/0693
See application file for complete search history.

(56) References Cited

U.S. PATENT DOCUMENTS

| | | | | |
|---|---|---|---|---|
| 10,997,898 | B2 * | 5/2021 | Wang | G09G 3/3291 |
| 2015/0091950 | A1 * | 4/2015 | Park | G09G 3/3208 345/83 |
| 2018/0137830 | A1 * | 5/2018 | Lee | G09G 3/2074 |
| 2018/0268780 | A1 * | 9/2018 | Bae | G09G 5/026 |
| 2021/0217345 | A1 * | 7/2021 | Kang | G09G 3/2003 |
| 2021/0407371 | A1 * | 12/2021 | Huang | G09G 3/20 |

FOREIGN PATENT DOCUMENTS

CN 110021271 A 7/2019

* cited by examiner

*Primary Examiner* — Michael J Eurice
(74) *Attorney, Agent, or Firm* — Kilpatrick Townsend & Stockton, LLP

(57) ABSTRACT

A display driving method, a display driver and a display device are provided. The display driving method includes acquiring a first grayscale of at least one to-be-displayed sub-pixel, performing a first compensation manner to compensate the first grayscale and acquire a second grayscale, determining whether the second grayscale is less than a critical value; if yes, performing a second compensation manner to compensate the second grayscale and acquire a third grayscale, and acquiring a data voltage based on the third grayscale to control the sub-pixel to emit light and display, and if no, acquiring a data voltage based on the second grayscale to control the sub-pixel to emit light and display. The problem of displaying color deviation when the display panel is displayed at a low grayscale can be avoided.

17 Claims, 11 Drawing Sheets

DISPLAY DRIVING METHOD, DISPLAY DRIVER, AND DISPLAY DEVICE

CROSS REFERENCE OF RELATED APPLICATION

The present application claims priority to Chinese Patent Application No. 202111639898.3, titled "DISPLAY DRIVING METHOD, DISPLAY DRIVER, AND DISPLAY DEVICE", filed on Dec. 29, 2021 with the China National Intellectual Property Administration, which is incorporated herein by reference in its entirety.

FIELD

The present disclosure relates to the field of image display, and in particular, to a display driving method, a display driver and a display device.

BACKGROUND

With the development of science and technology, more and more display devices are widely used in people's daily life and work, which brings great convenience and becomes an indispensable and important tool for people today.

A main component of a display device to realize a display function is a display panel. Currently, an organic light emitting diode (OLED) display panel is one of the mainstream display panels. Due to advantages of high contrast, ultra-thin and flexible, the OLED display panels are more and more widely used in various display devices.

The OLED display panel has a problem of uneven display brightness (that is, mura), and thus display compensation needs to be performed when an image is displayed.

SUMMARY

In view of this, a display driving method, a display driver and a display device are provided according to the present disclosure. The solutions are as follows.

A display driving method is applied to a display panel. The display driving method includes acquiring a first grayscale of at least one to-be-displayed sub-pixel; performing a first compensation manner to compensate the first grayscale and acquire a second grayscale; determining whether the second grayscale is less than a critical value; performing, if it is determined that the second grayscale is less than the critical value, a second compensation manner to compensate the second grayscale and acquire a third grayscale, and acquiring a data voltage based on the third grayscale to control the sub-pixel to emit light and display; and acquiring, if it is determined that the second grayscale is greater than or equal to the critical value, the data voltage based on the second grayscale to control the sub-pixel to emit light and display.

A display driver includes a first acquisition device, a first compensation device and a processing device. The first acquisition device is configured to acquire a first grayscale of at least one to-be-displayed sub-pixel. The first compensation device is configured to perform a first compensation manner, to compensate the first grayscale and acquire a second grayscale. The processing device is configured to determine whether the second grayscale is less than a critical value; perform, if it is determined that the second grayscale is less than the critical value, a second compensation manner to compensate the second grayscale and acquire a third grayscale, and acquire a data voltage based on the third grayscale to control the sub-pixel to emit light and display; and acquire, if it is determined that the second grayscale is greater than or equal to the critical value, a data voltage based on the second grayscale to control the sub-pixel to emit light and display.

A display device includes a display panel; and a display driver connected with the display panel. The display driver is configured to: acquire a first grayscale of at least one to-be-displayed sub-pixel; perform a first compensation manner, to compensate the first grayscale and acquire a second grayscale; determine whether the second grayscale is less than a critical value; perform, if it is determined that the second grayscale is less than the critical value, a second compensation manner to compensate the second grayscale and acquire a third grayscale, and acquire a data voltage based on the third grayscale to control the sub-pixel to emit light and display; and acquire, if it is determined that the second grayscale is greater than or equal to the critical value, a data voltage based on the second grayscale to control the sub-pixel to emit light and display.

It can be seen from the above description that, in the display driving method, the display driver and the display device according to the embodiments of the present disclosure, display compensation is performed on a to-be-displayed first grayscale of a to-be-displayed sub-pixel by a first compensation manner, to acquire a second grayscale. If the second grayscale is less than a critical value, the second grayscale is compensated by a second compensation manner to acquire a third grayscale, and a data voltage is acquired based on the third grayscale, to control the sub-pixel to emit light and display.

BRIEF DESCRIPTION OF THE DRAWINGS

In order to the embodiments of the present disclosure or in the conventional technology in details, drawings used in the description of the embodiments or the conventional technology are described simply in the following. It is apparent that the drawings in the following description only show some embodiments of the disclosure.

The structure, proportion, and size shown in the drawings of the specification are only used to match the contents disclosed in the specification, and are not intended to limit the conditions under which the present disclosure can be implemented, having no technically significance. Any modification of structure, change of proportional relationship, or adjustment of size should still fall within the scope of the content disclosed in the present disclosure without affecting the efficacy and purpose of the present disclosure.

DETAILED DESCRIPTION

Hereinafter, the embodiments of the present disclosure are described clearly and completely in conjunction with the drawings in the embodiments of the present disclosure hereinafter. It is apparent that the described embodiments are only some rather than all embodiments of the present disclosure.

Figure 1:
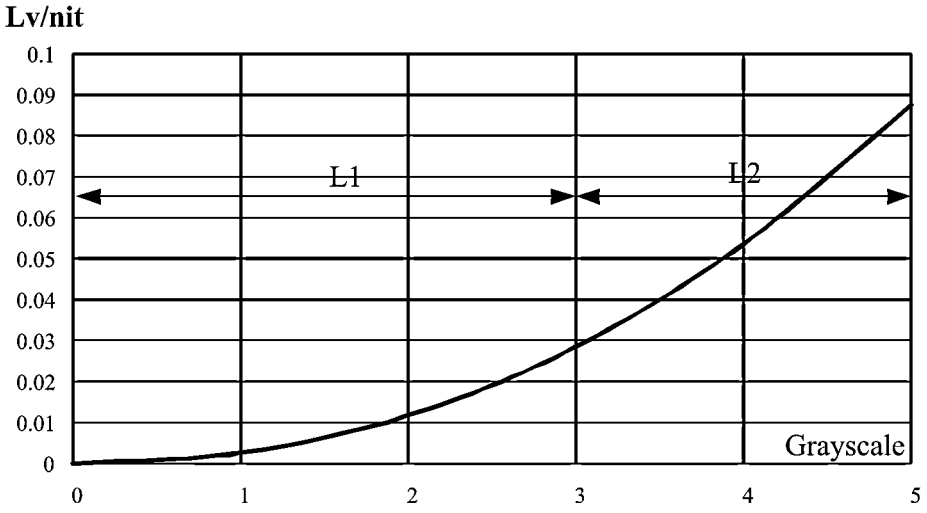
FIG. 1 is a schematic drawing of a gamma curve at a low grayscale according to the conventional technology.
Figure 2:
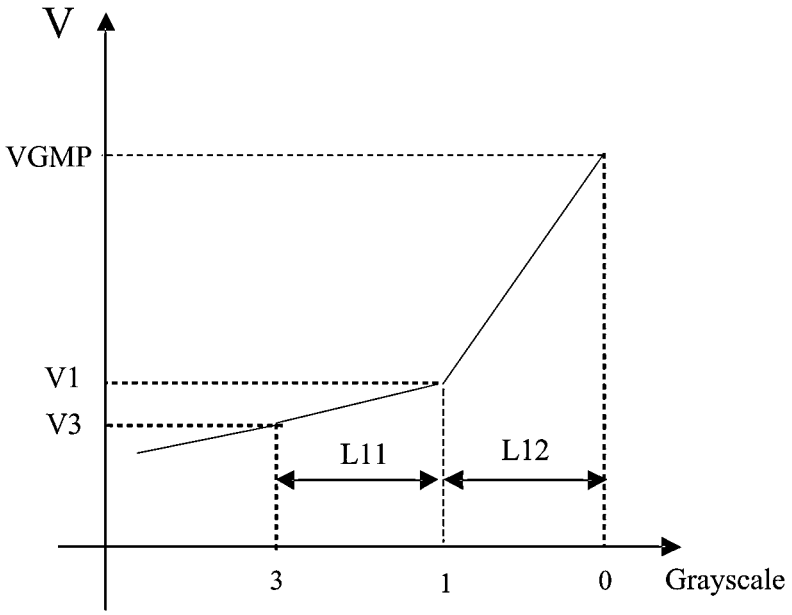
FIG. 2 is a schematic drawing of interpolation in a gamma curve at a low grayscale according to the conventional technology.

As shown in FIGS. 1 and 2, FIG. 1 is a schematic drawing of a gamma curve at a low grayscale, and FIG. 2 is a schematic drawing of interpolation in a gamma curve at a low grayscale. In FIG. 1, a horizontal axis represents a grayscale, and a vertical axis represents brightness. In FIG. 2, a horizontal axis represents a grayscale, and a vertical axis represents a data voltage.

Currently, display compensation is performed on a display panel based on a gamma curve in a case of uneven display brightness. A low grayscale may be compensated to 0-grayscale. A data voltage corresponding to a grayscale between the 0-grayscale and a 1-grayscale is acquired by performing interpolation operation on a data voltage VGMP corresponding to the 0-grayscale and a data voltage V1 corresponding to the 1-grayscale. The data voltage VGMP corresponding to the 0-grayscale is set to a constant voltage. In a case that a data voltage inputted by a sub-pixel is less than or equal to the data voltage VGMP, the sub-pixel is at the 0-grayscale.

In a conventional compensation method, if a to-be-displayed grayscale of a sub-pixel is a 3-grayscale, display compensation is performed on the sub-pixel at the 3-grayscale to achieve target brightness. As shown in FIG. 1, the 3-grayscale is compensated downward to be located in a region L1, and the 3-grayscale is compensated upward to be located in a region L2. Normally, a maximum difference between a grayscale after compensation and a grayscale before compensation is less than or equal to 7. A minimum in the region L1 for downward compensation is 0-grayscale, while a maximum in the region L2 for upward compensation is not limited, and thus the maximum in the region L2 for upward compensation may be 10-grayscale.

In the above compensation method, when the low grayscale is compensated, a compensated grayscale is acquired by interpolation operation based on a normal gamma curve, in which the 0-grayscale normally transits to the 1-grayscale, and no color deviation is between the 0-grayscale and the 1-grayscale. However, in practices, the 0-grayscale in the gamma curve is not a calibrated grayscale, and the data voltage corresponding to the 0-grayscale is a voltage constant set based on a display demand of manufacturers. In FIGS. 1 and 2, for example, the 1-grayscale serves as a minimum calibrated grayscale of the gamma curve. A data voltage corresponding to a grayscale between the 0-grayscale and the 1-grayscale is acquired by performing interpolation operation on a data voltage VGMP corresponding to the 0-grayscale and a data voltage V1 corresponding to the 1-grayscale.

Since the data voltage VGMP is not a data voltage corresponding to a calibrated grayscale on the normal gamma curve, the gamma curve is in an abnormal state between the 0-grayscale and the 1-grayscale. Therefore, for example, the 3-grayscale serves as a to-be-compensated grayscale, when the 3-grayscale is compensated downward, if a compensated grayscale is located between the 1-grayscale and the 3-grayscale (that is, a region L11 in FIG. 2), a result between the 1-grayscale and the 3-grayscale by interpolation operation have a small deviation relative to an actual value due to an inherent error of the interpolation operation, resulting in displaying color deviation. The displaying color deviation meets requirements of a display standard and cannot be distinguished by human eyes. If the compensated grayscale is located between the 0-grayscale and the 1-grayscale (that is, a region L12 in FIG. 2), not only the inherent error of the interpolation operation, but also since the data voltage VGMP is not the data voltage corresponding to the calibrated grayscale on the normal gamma curve, a result between the 1-grayscale and the 3-grayscale by interpolation operation have a large deviation relative to an actual value, resulting in a large displaying color deviation. The displaying color deviation is greater than an allowable range of error, does not meet the requirements of the display standard, and may be recognized by human eyes, affecting display quality.

In order to solve the above problems, a display driving method, a display driver and a display device are provided according to the embodiments of the present disclosure. According to the technical solutions of embodiments of the present disclosure, when display compensation is performed on a to-be-displayed first grayscale of a to-be-displayed sub-pixel, a secondary compensation may be performed if a second grayscale acquired by a first compensation manner is less than a critical value, and a third grayscale is acquired by a second compensation manner, to solve the problem of displaying color deviation caused by a compensated grayscale located between the 0-grayscale and the minimum calibrated grayscale of the gamma curve in the conventional compensation method in which compensation is performed once.

Embodiments of the present disclosure are further described in detail below in conjunction with the drawings and specific embodiments.

Figure 3:
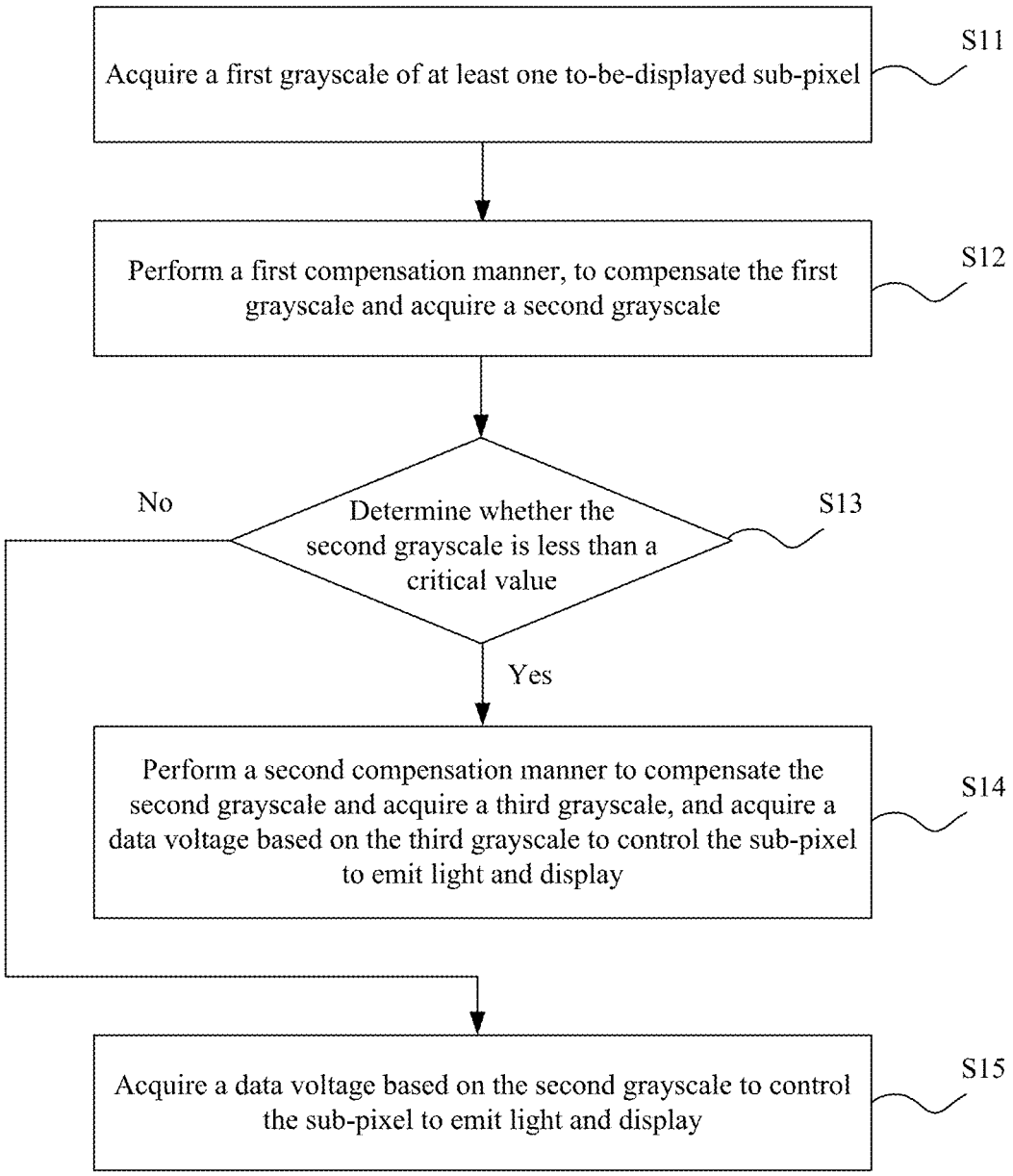
FIG. 3 is a flow chart of a display driving method according to an embodiment of the present disclosure.

Reference is made to FIG. 3, which is a flow chart of a display driving method according to an embodiment of the present disclosure. The display driving method is applied to a display panel. The display driving method includes the following steps S11 to S15.

In step S11, a first grayscale of at least one to-be-displayed sub-pixel is acquired.

In an embodiment, to-be-displayed first grayscales of all to-be-displayed sub-pixels are acquired, and display compensation is performed on the to-be-displayed sub-pixels based on the display driving method. In addition, in another method, to-be-displayed first grayscales of a part of the to-be-displayed sub-pixels may be acquired, and display compensate is performed on the part of the to-be-displayed sub-pixels.

The display panel includes a red sub-pixel R, a green sub-pixel G and a blue sub-pixel B. The display panel may be an OLED display panel, and the sub-pixel is an OLED light-emitting element. It should be noted that a pixel structure of the display panel in the embodiment of the present disclosure is not limited to a pixel structure of RGB. Based on the pixel structure of RGB, the display panel further includes a white sub-pixel W or a yellow sub-pixel Y.

In step S12, the first compensation manner is performed, to compensate the first grayscale and acquire the second grayscale.

In step S13, it is determined whether the second grayscale is less than a critical value.

The critical value is the minimum calibrated grayscale of the gamma curve, and may be set according to an actual gamma curve of the display panel or display requirements of customers on brightness at the low grayscale. For example, the critical value may be set as the 1-grayscale or the 2-grayscale. The critical value is not limited in the embodiment of the present disclosure.

In step S14, if it is determined that the second grayscale is less than the critical value, the second compensation manner is performed to compensate the second grayscale and acquire the third grayscale, and a data voltage is acquired based on the third grayscale to control the sub-pixel to emit light and display.

In step S15, if it is determined that the second grayscale is greater than or equal to the critical value, a data voltage is acquired based on the second grayscale to control the sub-pixel to emit light and display.

The display compensation is performed on the first grayscale in the first compensation manner, to acquire the second grayscale. In a case that the second grayscale is less than the critical value, it indicates that the second grayscale is located between the 0-grayscale and the critical value when the first grayscale is compensated downward in the first compensation manner. If the sub-pixel is controlled to emit light and display based on the data voltage determined by the second grayscale, it results in displaying color deviation.

It can be seen from the above description that in the display driving method according to the embodiment of the present disclosure, when display compensation is performed on a to-be-displayed first grayscale of a to-be-displayed sub-pixel, a secondary compensation may be performed if a second grayscale acquired by a first compensation manner is less than a critical value, and a third grayscale is acquired by a second compensation manner, to solve the problem of displaying color deviation caused by a compensated grayscale located between the 0-grayscale and the minimum calibrated grayscale of the gamma curve in the conventional compensation method in which compensation is performed once.

In the display driving method according to the embodiment of the present disclosure, an absolute value of a difference between the third grayscale and the critical value is set to be less than an absolute value of a difference between the critical value and the second grayscale. As described above, in a case that the second grayscale is less than the critical value, the second grayscale is located between the 0-grayscale and the critical value. If the sub-pixel is controlled to emit light and display based on the data voltage determined by the second grayscale, it results in displaying color deviation. By setting the absolute value of the difference between the third grayscale and the critical value to be less than the absolute value of the difference between the critical value and the second grayscale, the third grayscale for determining a final data voltage is closer to the critical value relative to the second grayscale, to reduce degree of color deviation.

In an embodiment, a method for performing the second compensation manner includes determining the critical value as the third grayscale. In the method, in the primary compensation, the first compensation manner is performed to perform display compensation on the first grayscale to acquire the second grayscale. In a case that the second grayscale is less than the critical value, the second compensation manner is performed in the secondary compensation, to directly determine the critical value as the third grayscale, and the third grayscale is located in a color non-deviation region on the gamma curve, which can avoid that the first grayscale is abnormal during downward compensation, to greatly eliminate the displaying color deviation.

Figure 4:
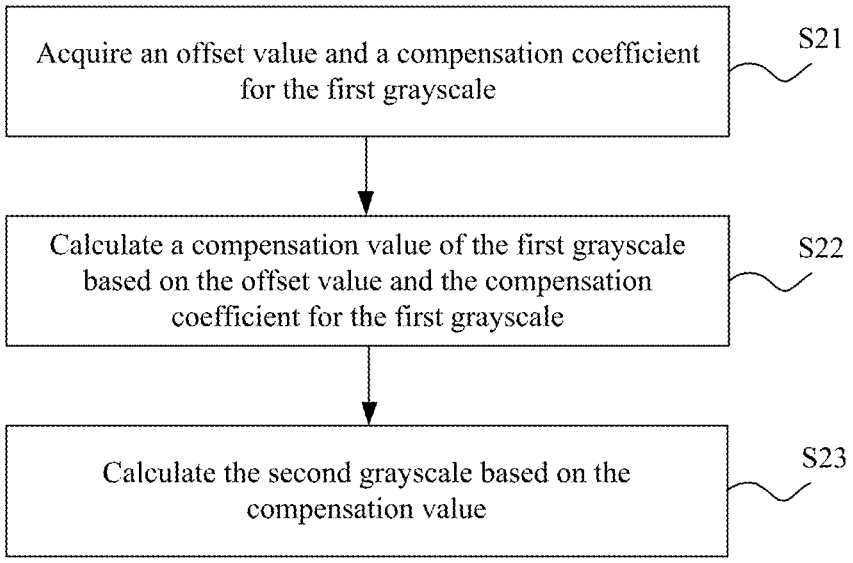
FIG. 4 is a flow chart of a method for performing a first compensation manner according to an embodiment of the present disclosure.

Reference is made to FIG. 4, which is a flow chart of a method for performing a first compensation manner according to an embodiment of the present disclosure. In an embodiment of the present disclosure, the method for performing a first compensation manner includes the following steps S21 to S23.

In step S21, an offset value and a compensation coefficient for the first grayscale are acquired.

In step S22, a compensation value of the first grayscale is calculated based on the offset value and the compensation coefficient for the first grayscale.

In step S23, the second grayscale is calculated based on the compensation value of the first grayscale.

The compensation value may be calculated based on the offset value and the compensation coefficient for the first grayscale, and the second grayscale is calculated based on the compensation value, to achieve a primary display compensation. In a case that the second grayscale is greater than or equal to the critical value, a data voltage is determined based on the second grayscale to control the sub-pixel to emit light and display, and the problem of uneven display brightness can be solved. In a case that the second grayscale is less than the critical value, the secondary display compensation is further performed in the second compensation manner, to determine the third grayscale, to determine a data voltage based on the third grayscale to control the sub-pixel to emit light and display, which can solve the problem of uneven display brightness, and further solve the problem of displaying color deviation caused by the second grayscale less than the critical value in the abnormal displaying region during downward compensation.

In an embodiment, in the method shown in FIG. 4, the compensation value is equal to a product of the offset value and the compensation coefficient, and the second grayscale is equal to a sum of the first grayscale and the compensation value. The second grayscale may be acquired based on the compensation value by the calculation method, and is used to compare with the critical value, to determine an appropriate data voltage based on a comparison result, to solve the problem of uneven display brightness.

The offset value may be positive or negative. The compensation coefficient is set to a positive constant. If the compensation value is positive, the second grayscale is greater than the first grayscale, it indicates that the first grayscale is compensated upward. If the compensation value is negative, the second grayscale is less than the first grayscale, it indicates that the first grayscale is compensated downward and the display panel may have displaying color deviation. In a case that the second grayscale is less than the critical value, the display panel has the displaying color deviation, and the secondary display compensation may be performed in the second compensation manner to eliminate the displaying color deviation. Before the display panel leaves a factory, a compensation coefficient and an offset value corresponding to each of multiple standard grayscales of the sub-pixel may be acquired through an actual emitting-light and display test of the display panel. The compensation coefficient corresponding to the standard grayscale is determined as a constant greater than or equal to 1 based on a compensation demand.

A display area of the display panel includes a central area and an edge area surrounding the central area. The central area and the edge area each have multiple sub-pixels.

The sub-pixels located in the edge area of the display panel when emitting-light and displaying normally requires display compensation to solve the problem of uneven display brightness relative to the central area. If the sub-pixel at the first grayscale has high brightness, a negative compensation value is required, and the second grayscale is less than the first grayscale after compensation, to reduce actual display brightness of the sub-pixel. If the sub-pixel at the first grayscale has low brightness, a positive compensation value is required, and the second grayscale is greater than the first grayscale after compensation, to increase actual display brightness of the sub-pixel, to achieve brightness uniformity of the central area and the edge area of the display panel. According to the embodiments of the present disclosure, the problem of uneven display brightness cannot only be solved by the compensation value when the second grayscale is greater than or equal to the critical value, but also the second grayscale is compensated in the second compensation manner when the second grayscale is less than the critical value, which can avoid the color deviation of the second grayscale located in the abnormal displaying region on the gamma curve, and solve the problem of uneven display brightness by maximum downward compensation.

In the embodiment of the present disclosure, in the step S21, the acquiring the offset value and the compensation coefficient for the first grayscale includes: determining the offset value and the compensation coefficient for the first grayscale based on multiple pre-stored standard grayscales and an offset value and a compensation coefficient corresponding to each of the multiple standard grayscales. For example, the standard grayscales include a 7-grayscale. An offset value corresponding to the 7-grayscale is −2, and a compensation coefficient corresponding to the 7-grayscale is 1. In one embodiment, the standard grayscales include a 4-grayscale. An offset value corresponding to the 4-grayscale is 3, and a compensation coefficient corresponding to the 4-grayscale is 1. A compensation value and a compensation coefficient corresponding to each of the standard grayscales are determined based on actual measurement results before he display panel leaves the factory.

Before the display panel leaves the factory, actual brightness of sub-pixels on the display panel at each of the multiple standard grayscales is acquired by a measurement device, to determine the offset value and the compensation coefficient corresponding to the standard grayscale, and store the standard grayscale and the offset value and the compensation coefficient corresponding to the standard grayscale, and the second grayscale is calculated in the first compensation manner during display driving.

Figure 5:
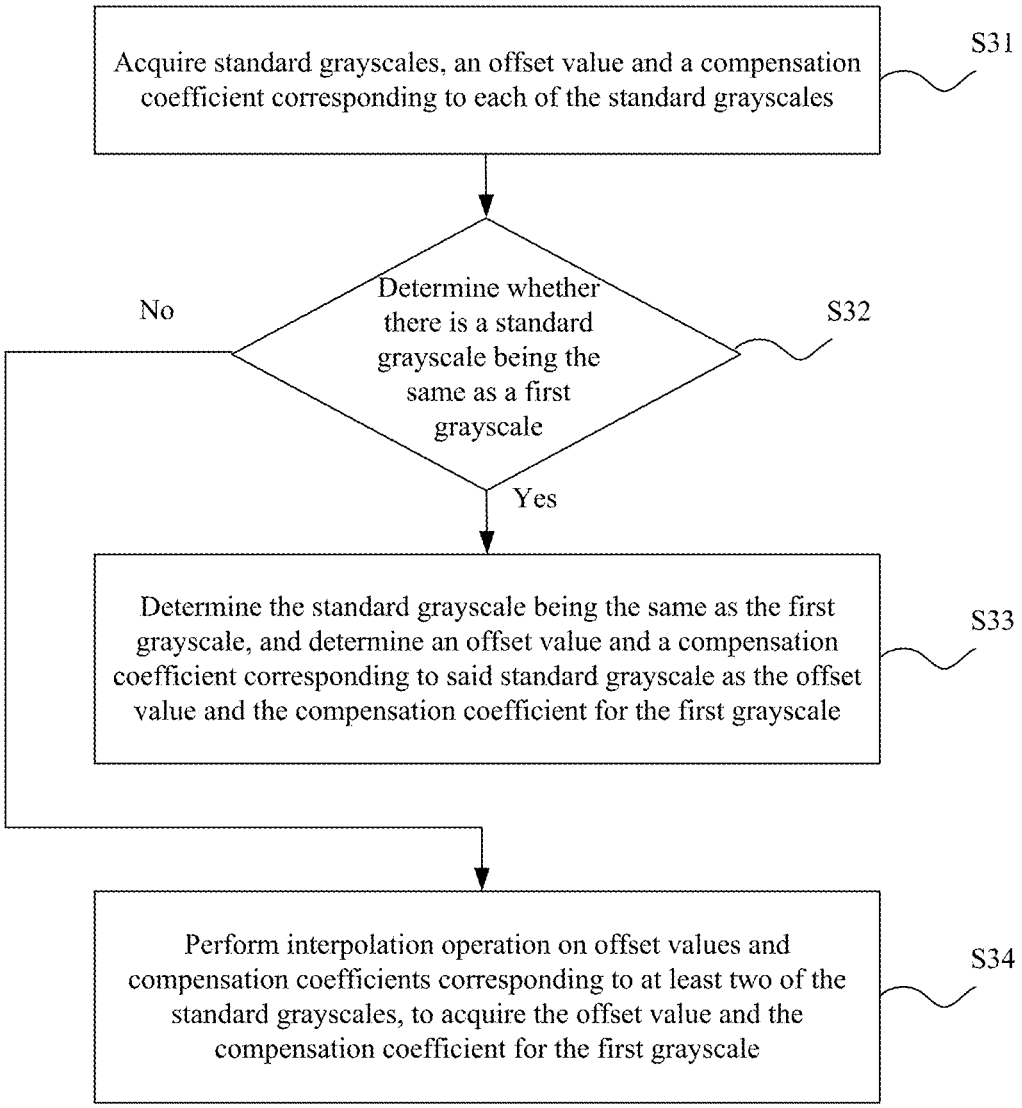
FIG. 5 is a flow chart of a method for acquiring an offset value and a compensation coefficient for a first grayscale according to an embodiment of the present disclosure.

Reference is made to FIG. 5, which is a flow chart of a method for acquiring an offset value and a compensation coefficient for a first grayscale according to an embodiment of the present disclosure. In the embodiment of the present disclosure, the acquiring the offset value and the compensation coefficient for the first grayscale specifically includes the following steps S31 to S34.

In step S31, the standard grayscales, the offset value and the compensation coefficient corresponding to each of the standard grayscales are acquired.

The multiple standard grayscales and the offset value and the compensation coefficient corresponding to each of the multiple standard grayscales may be stored in a data table. When the first compensation manner is performed, the pre-stored data table may be called to read data in the data table, to acquire the standard grayscales, and the offset value and the compensation coefficient corresponding to each of the standard grayscales.

In step S32, it is determined whether there is a standard grayscale being the same as the first grayscale.

In step S33, if it is determined that there is a standard grayscale being the same as the first grayscale, the standard grayscale being the same as the first grayscale is determined, and an offset value and a compensation coefficient corresponding to said standard grayscale are determined as the offset value and the compensation coefficient for the first grayscale.

In step S34, if it is determined that there is no standard grayscale being the same as the first grayscale, interpolation operation is performed on offset values and compensation coefficients corresponding to at least two of the standard grayscales, to acquire the offset value and the compensation coefficient for the first grayscale.

When an offset value and a compensation coefficient corresponding to each of multiple different standard grayscales are determined before the display panel leaves the factory, since the sub-pixels of the display panel have a large number of display grayscales, some of the grayscales are normally determined as standard grayscales for measurement to determine an offset value and a compensation coefficient corresponding to each of the standard grayscales, to reduce the number of measurements and data storage amount. During the display driving, the first grayscale is compared with the pre-stored standard grayscales, if there is a standard grayscale being the same as the first grayscale, the compensation value and the compensation coefficient corresponding to the standard grayscale are directly determined as the offset value and the compensation coefficient for the first grayscale; if there is no standard grayscale being the same as the first grayscale, the offset value and the compensation coefficient for the first grayscale are acquired by performing interpolation operation on other grayscales, which can be reduce a measurement time period and data storage amount before the display panel leaves the factory.

In the embodiment of the present disclosure, the display panel is provided with a display driving chip and a memory. The memory may be a flash memory. The memory stores the gamma curve, or stores multiple gamma calibrated grayscales and brightness corresponding to each of the gamma calibrated grayscales for representing the gamma curve. The critical value is a minimum calibrated grayscale of the gamma curve. In this way, when the first grayscale is compensated downward, a compensated grayscale may be located outside a region in which interpolation is inaccurate on the gamma curve and the first grayscale can be greatly compensated downward, which can avoid displaying color deviation caused by over-compensation, and solve the problem of uneven display brightness. The memory further stores the standard grayscales and the offset value and the compensation coefficient corresponding to each of the standard grayscales.

Figure 6:
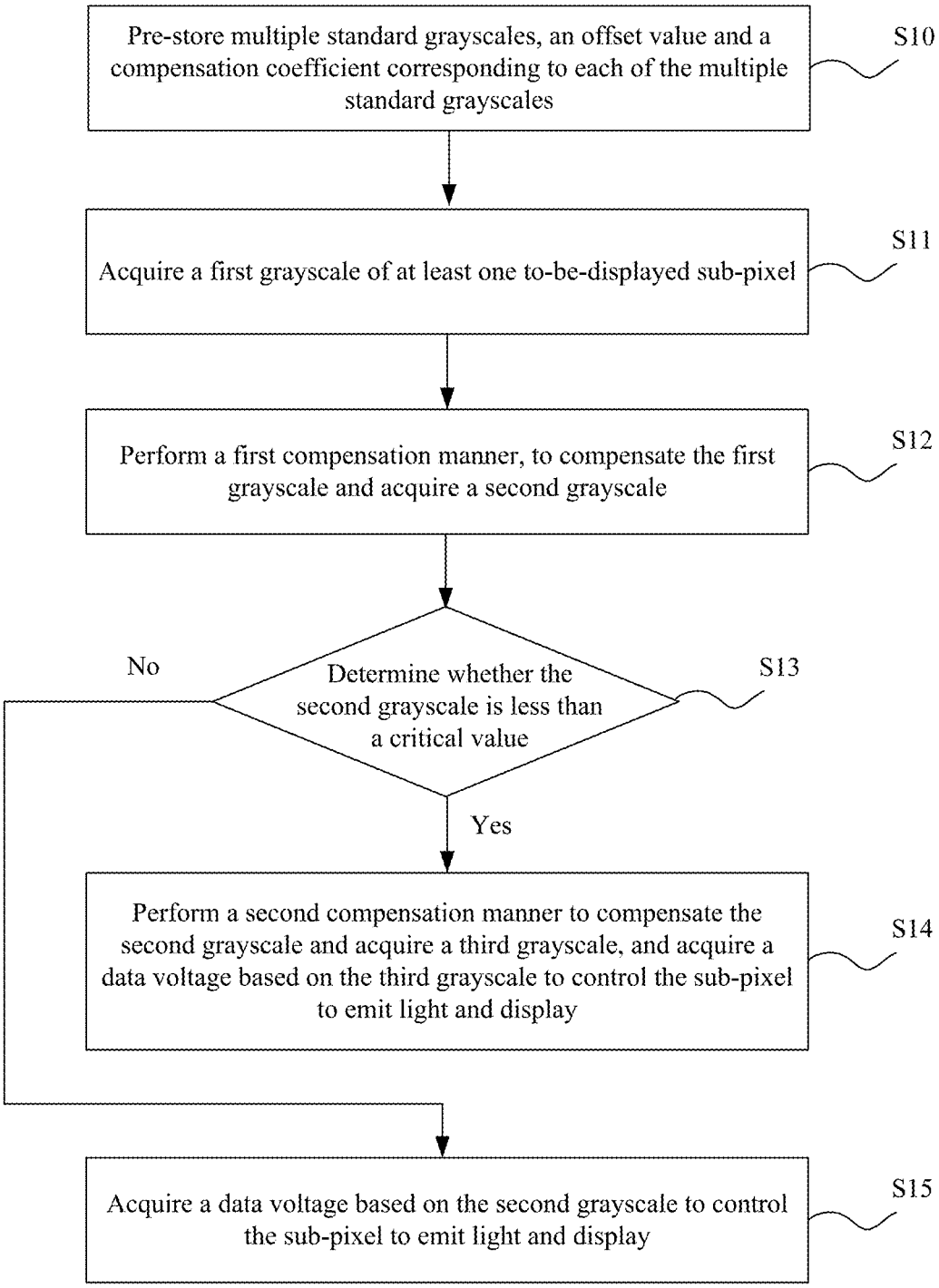
FIG. 6 is a flow chart of a display driving method according to an embodiment of the present disclosure.

Reference is made to FIG. 6, which is a flow chart of a display driving method according to an embodiment of the present disclosure. Based on the display driving method shown in FIG. 3, the display driving method shown in FIG. 6 further includes step S10. In step S10, multiple standard grayscales, an offset value and a compensation coefficient corresponding to each of the multiple standard grayscales are pre-stored. As described above, the multiple standard grayscales and the offset value and the compensation coefficient corresponding to each of the multiple standard grayscales may be stored in a data table. During the display driving, when the first compensation manner is performed, the multiple standard grayscales, and the offset value and the compensation coefficient corresponding to each of multiple standard grayscales that are pre-stored may be directly read, to calculate the compensation value.

In the method shown in FIG. 6, before the display panel leaves the factory, actual brightness of sub-pixels on the display panel may be measured by a measurement device to acquire the offset value and the compensation coefficient corresponding to each of the multiple standard grayscales, and the compensated grayscale is determined by directly reading the stored data during display compensation, to control the sub-pixels to emit light and display.

It can be seen that in the embodiment of the present disclosure, a method for determining a data voltage based on a set grayscale includes: pre-storing a data voltage corresponding to the set grayscale and directly reading the data voltage corresponding to the set grayscale; or pre-storing a data voltage corresponding to each of multiple grayscales, where each of the multiple grayscales is different from the set grayscale, and performing interpolation operation on data voltages corresponding to two of the multiple grayscales, to determine the data voltage corresponding to the set grayscale. In addition, the data voltage corresponding to the set grayscale may further be acquired according to another method.

Therefore, in the display driving method according to the embodiment of the present disclosure, if the critical value is determined as the third grayscale, the method for determining a data voltage based on the critical value includes: pre-storing a data voltage corresponding to the critical value, and directly reading the data voltage corresponding to the critical value; or pre-storing a data voltage corresponding to each of the multiple grayscales, where each of the multiple grayscales is different from the critical value, and performing interpolation operation on data voltages corresponding to two of the multiple grayscales, to determine the data voltage corresponding to the critical value.

In addition, in a case that the second grayscale is greater than or equal to the critical value, the method for determining a data voltage based on the second grayscale includes: pre-storing a data voltage corresponding to the second grayscale, and directly reading the data voltage corresponding to the second grayscale; or pre-storing a data voltage corresponding to each of the multiple grayscales, where each of the multiple grayscales is different from the second grayscale, and performing interpolation operation on data voltages corresponding to two of the multiple grayscales, to determine the data voltage corresponding to the second grayscale.

Next, for the display panel with minimum calibrated grayscales of different gamma curves, the display compensation is further described according to the display driving method described in the embodiments of the present disclosure.

Figure 7:
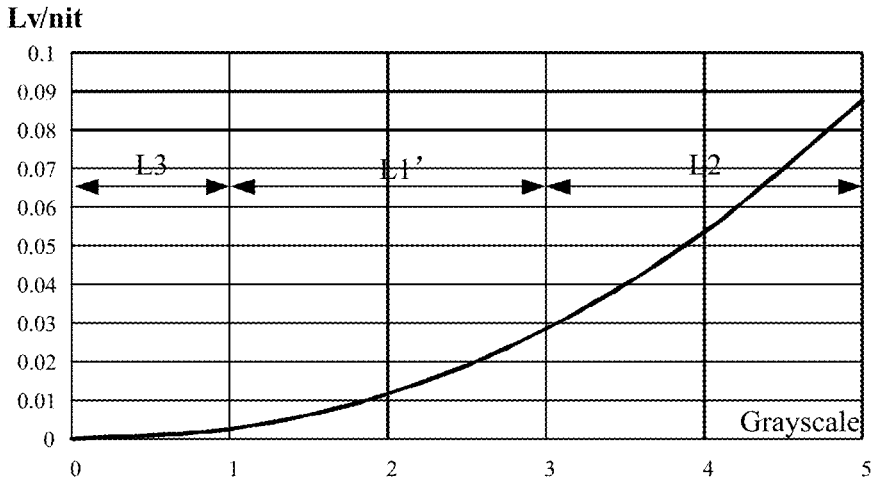
FIG. 7 is a schematic drawing of a gamma curve at a low grayscale according to an embodiment of the present disclosure.
Figure 8:
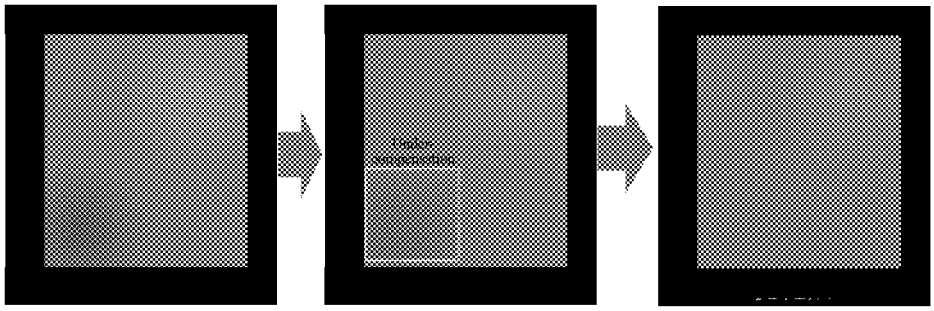
FIG. 8 is a schematic drawing showing a displaying effect of a display panel according to an embodiment of the present disclosure.

As shown in FIGS. 7 and 8, FIG. 7 is a schematic drawing of a gamma curve at a low grayscale according to an embodiment of the present disclosure, and FIG. 8 is a schematic drawing showing a displaying effect of a display panel according to an embodiment of the present disclosure. In FIG. 7, a horizontal axis represents a grayscale, a vertical axis represents brightness, and a minimum calibrated grayscale of the gamma curve is 1. The left in FIG. 8 shows a displaying effect without display compensation, the middle in FIG. 8 shows a displaying effect after compensation according to the conventional compensation method, and the right in FIG. 8 shows a displaying effect after compensation in the display driving method according to the present disclosure. For example, a to-be-displayed first grayscale of a to-be-displayed sub-pixel is the 3-grayscale. If downward compensation is performed, since the 0-grayscale is not a calibrated grayscale of the gamma curve and a region L3 located between the 0-grayscale and the 1-grayscale is the abnormal displaying region, a compensation region L1' is required to be located between the 1-grayscale and the 3-grayscale. If upward compensation is performed, a compensation region L2 is located in a region greater than 3-grayscale.

If a sub-pixel requires downward compensation at the 3-grayscale, an offset value is −7. In the conventional compensation method, in order to avoid that a compensated grayscale is located in the abnormal displaying region L3 less than the 1-grayscale when a low grayscale is compensated downward, it is required to set a compensation coefficient Gain, to at least meet the following equations: $3+(-7\times Gain)=1$, and Gain is equal to 2/7 and is approximately equal to 2.85. In this way, an actual compensation value is −2 when downward compensation is performed, to avoid that a compensated grayscale is located in the abnormal displaying region L3 of the gamma curve. In order to reduce the number of measurements and data storage amount before the display panel leaves the factory, and make the compensation algorithm simple, different sub-pixels adopt a same compensation coefficient and an offset value of with same amplitude at a same grayscale. In such case, upward compensation is required to performed on another sub-pixel at the 3-grayscale, and the offset value is 7. Due to the same compensation coefficient, the actual compensation value for upward compensation is 2, and the amplitude of the compensation value is less than the amplitude of the offset value, which reduces the brightness of the sub-pixel after upward compensation. As shown in the middle of FIG. 8, a lower left corner of FIG. 8 has a problem of under-compensation. Compared with the left of FIG. 8, although brightness in an area in a dotted box is improved and a brightness difference between the lower left corner and the middle area is reduced, the lower left corner has lower brightness.

Based on a gamma curve shown in FIG. 7, in the display driving method according to the embodiment of the present disclosure, the compensation coefficient may be greater than or equal to 1. In an embodiment, a sub-pixel is compensated downward at the 3-grayscale, the offset value is −7, and the compensation coefficient Gain may be set to 1. After the first compensation manner is performed, the second grayscale is calculated by $3-7\times1$, and is less than 1. The second grayscale is compensated in the second compensation manner, to acquire the third grayscale, and the third grayscale is equal to 1, to avoid that the compensated grayscale is located in the abnormal displaying region L3 of the gamma curve. If another sub-pixel is compensated upward at the 3-grayscale, the offset value is 7, the compensation coefficient Gain is 1, and the actual compensation value of the upward compensation is 7, as shown in the right of FIG. 8, which can ensure the upward compensation effect of the sub-pixel and achieve better display uniformity.

Figure 9:
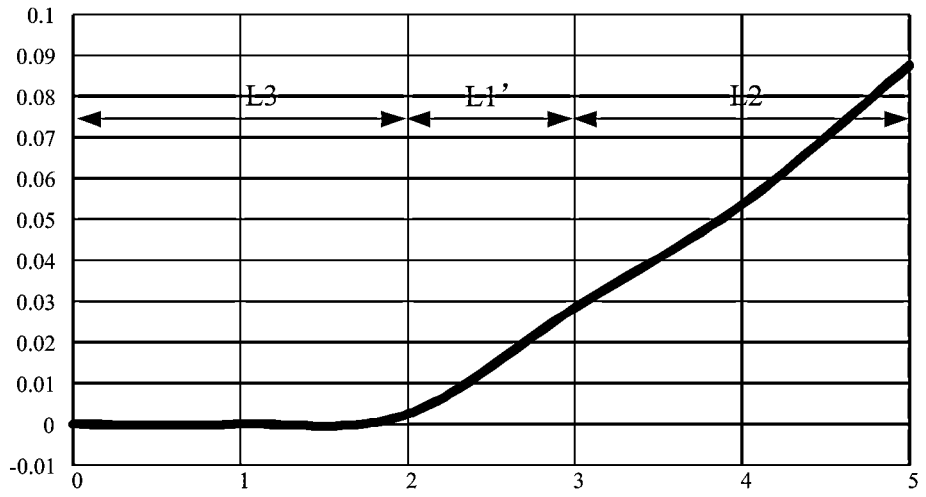
FIG. 9 is a schematic drawing of a gamma curve at a low grayscale according to another embodiment of the present disclosure.

Reference is made to FIG. 9, which is a schematic drawing of a gamma curve at a low grayscale according to another embodiment of the present disclosure. In FIG. 9, a horizontal axis represents a grayscale, a vertical axis represents brightness, and a minimum calibrated grayscale of the gamma curve is 2. For example, a to-be-displayed first grayscale of a to-be-displayed sub-pixel is the 3-grayscale. If downward compensation is performed, since the 0-grayscale is not a calibrated grayscale of the gamma curve and a region L3 located between the 0-grayscale and the 2-grayscale is the abnormal displaying region, a compensation region L1' is required to be located between the 2-grayscale and the 3-grayscale. If upward compensation is performed, a compensation region L2 is located in a region greater than 3-grayscale.

If a sub-pixel is compensated upward at the 3-grayscale, an offset value is −7. In the conventional compensation method, in order to avoid that a compensated grayscale is located in the abnormal displaying region L3 less than the 1-grayscale when a low-grayscale is compensated downward, it is required to set a compensation coefficient Gain, to at least meet the following equations: $3+(-7\times Gain)=2$, and Gain is equal to 1/7 and is approximately equal to 0.143. In this way, an actual compensation value is −2 when downward compensation is performed, to avoid that a compensated grayscale is located in the abnormal displaying region L3 of the gamma curve. In such case, upward compensation is required to performed on another sub-pixel at the 3-grayscale, the actual offset value is 7, and the amplitude of the compensation value is less than the amplitude of the offset value, which reduces the brightness of the sub-pixel after upward compensation.

Based on a gamma curve shown in FIG. 9, in the display driving method according to the embodiment of the present disclosure, the compensation coefficient may be greater than or equal to 1. In an embodiment, a sub-pixel is compensated downward at the 3-grayscale, the offset value is −7, and the compensation coefficient Gain may be set to 1. After the first compensation manner is performed, the second grayscale is calculated by $3-7\times1$, and is less than 2. The second grayscale is compensated in the second compensation manner, to acquire the third grayscale, and the third grayscale is equal to 1, to avoid that the compensated grayscale is located in the abnormal displaying region L3 of the gamma curve. If another sub-pixel is compensated upward at the 3-grayscale, the offset value is 7, the compensation coefficient Gain is equal to 1, and the actual compensation value of the upward compensation is 7, which can ensure the upward compensation effect of the sub-pixel and achieve better display uniformity.

In the above description, the compensation coefficient corresponding to 3-grayscale is set to 1. Further, a compensation coefficient corresponding to a standard grayscale may be set based on an actual test result. The compensation coefficient is not limited to 1, and may be a coefficient greater than 1, which is not limited in the embodiment of the present disclosure. It can be seen that in the display driving method according to the embodiment of the present disclosure, after the to-be-displayed sub-pixel is compensated in the first compensation manner, if the second grayscale is less than the critical value, and the third grayscale may be acquired in the second compensation manner. Therefore, the problem of displaying color deviation caused by over-compensation of the low grayscale can be solved, and the brightness uniformity of the display panel can be greatly improved.

According to the display driving method according to the embodiments of the present disclosure, the visual effect shows that different compensation coefficients are set, to avoid that the low-grayscale is compensated to the abnormal displaying region. In one embodiment, according to the display driving method according to the embodiments of the present disclosure, a test result based on the data voltage shows that different compensation coefficients are set, to avoid that the low-grayscale is compensated to the abnormal displaying region.

Based on the above embodiments of the display driving method, a display driver is further provided according to another embodiment of the present disclosure, and is configured to perform the display driving method.

Figure 10:
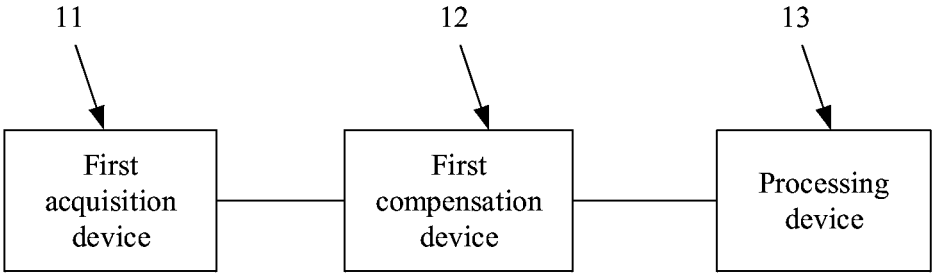
FIG. 10 is a schematic structural drawing of a display driver according to an embodiment of the present disclosure.

Reference is made to FIG. 10, which is a schematic structural drawing of a display driver according to an embodiment of the present disclosure. The display driver includes a first acquisition device 11, a first compensation device 12, and a processing device 13. The first acquisition device 11 is configured to acquire a first grayscale of at least one to-be-displayed sub-pixel. The first compensation device 12 is configured to perform a first compensation manner, to compensate the first grayscale and acquire a second grayscale. The processing device 13 is configured to determine whether the second grayscale is less than a critical value; perform, if it is determined that the second grayscale is less than the critical value, a second compensation manner to compensate the second grayscale and acquire a third grayscale, and acquire a data voltage based on the third grayscale to control the sub-pixel to emit light and display; and acquire, if it is determined that the second grayscale is greater than or equal to the critical value, a data voltage based on the second grayscale to control the sub-pixel to emit light and display.

When the display driver according to the embodiment of the present disclosure controls a display panel to emit light and display, display compensation is performed on a to-be-displayed first grayscale of a to-be-displayed sub-pixel, a secondary compensation may be performed if a second grayscale acquired by a first compensation manner is less than a critical value, and a third grayscale is acquired by a second compensation manner, to solve the problem of displaying color deviation caused by a compensated grayscale located between the 0-grayscale and the minimum calibrated grayscale of the gamma curve in the conventional compensation method in which compensation is performed once.

In the display driver according to the embodiment of the present disclosure, an absolute value of a difference between the third grayscale and the critical value is less than an absolute value of a difference between the critical value and the second grayscale. By setting the absolute value of the difference between the third grayscale and the critical value to be less than the absolute value of the difference between the critical value and the second grayscale, the third grayscale for determining a final data voltage is closer to the critical value relative to the second grayscale, to reduce degree of color deviation.

In an embodiment, if the second grayscale is less than the critical value, the processing device 13 is configured to determine the critical value as the third grayscale. The processing device 13 performs the first compensation manner, to compensate the first grayscale, and acquire the second grayscale; and performs, if the second grayscale is less than the critical value, the second compensation manner, and directly determines the critical value as the third grayscale, and the third grayscale is located in the color non-deviation region on the gamma curve, which can avoid that the first grayscale is abnormal during downward compensation, to greatly eliminate the displaying color deviation.

Figure 11:
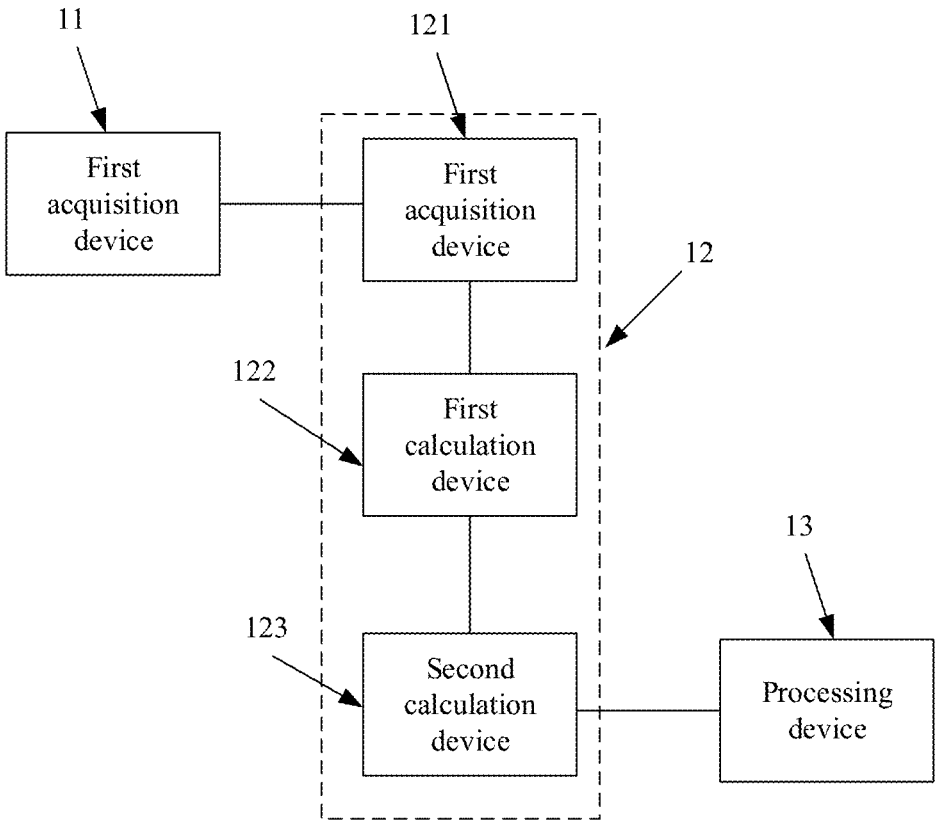
FIG. 11 is a schematic structural drawing of a display driver according to another embodiment of the present disclosure.

Reference is made to FIG. 11, which is a schematic structural drawing of a display driver according to another embodiment of the present disclosure. In an embodiment of the present disclosure, the first compensation device 12 includes a first acquisition device 121, a first calculation device 122 and a second calculation device 123. The first acquisition device 121 is configured to acquire an offset value and a compensation coefficient for the first grayscale. The first calculation device 122 is configured to calculate a compensation value of the first grayscale based on the offset value and the compensation coefficient for the first grayscale. The second calculation device 123 is configured to calculate the second grayscale based on the compensation value.

The first compensation device 12 may calculate the compensation value based on the offset value and the compensation coefficient for the first grayscale, and calculate the second grayscale based on the compensation value, to achieve a primary display compensation. In a case that the second grayscale is greater than or equal to the critical value, a data voltage is determined based on the second grayscale to control the sub-pixel to emit light and display, and the problem of uneven display brightness can be solved. In a case that the second grayscale is less than the critical value, the secondary display compensation is further performed by the processing device 13. Specifically, the processing device 13 performs the second compensation manner, to determine the third grayscale, to determine the data voltage based on the third grayscale to control the sub-pixel to emit light and display, which can solve the problem of uneven display brightness, and further solve the problem of displaying color deviation caused by the second grayscale less than the critical value in the abnormal displaying region during downward compensation.

In an embodiment, in the method shown in FIG. 11, the first calculation device 122 is configured to calculate a product of the offset value and the compensation coefficient, and determine the product as the compensation value. The second calculation device 123 is configured to calculate a sum of the first grayscale and the compensation value, and determine the sum as the second grayscale. The second grayscale acquired by calculation is compared with the critical value, to determine an appropriate data voltage based on a comparison result, to solve the problem of uneven display brightness.

In an embodiment, the first acquisition device 121 is configured to determine the offset value and the compensation coefficient for the first grayscale based on multiple pre-stored standard grayscales and an offset value and a compensation coefficient corresponding to each of the multiple standard grayscales. The pre-stored different standard grayscales and the offset value and the compensation coefficient corresponding to each of the standard gray scales are directly read, to determine the offset value and the compensation coefficient for the first gray scale.

Figure 12:
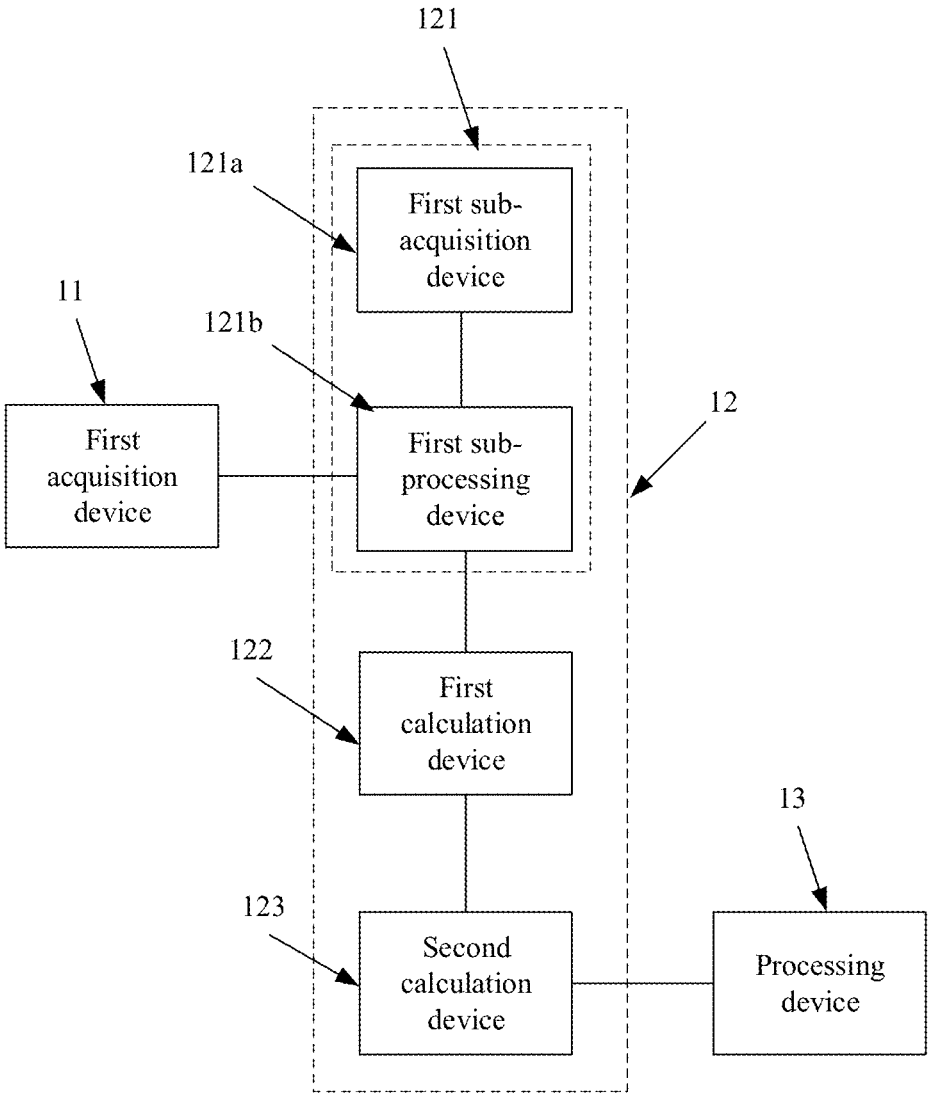
FIG. 12 is a schematic structural drawing of a display driver according to another embodiment of the present disclosure.

Reference is made to FIG. 12, which is a schematic structural drawing of a display driver according to another embodiment of the present disclosure. In an embodiment of the present disclosure, the first acquisition device 121 includes a first sub-acquisition device 121*a* and a first sub-processing device 121*b*. The first sub-acquisition device 121*a* is configured to acquire the standard grayscales, the offset value and the compensation coefficient corresponding to each of the standard grayscales. The first sub-processing device 121*b* is configured to determine whether there is a standard grayscale being the same as the first grayscale; determine, if it is determined that there is a standard grayscale being the same as the first grayscale, the standard grayscale being the same as the first grayscale, and determine an offset value and a compensation coefficient corresponding to said standard grayscale as the offset value and the compensation coefficient for the first grayscale; and perform, if it is determined that there is no standard grayscale being the same as the first grayscale, interpolation operation on offset values and compensation coefficients corresponding to at least two of the standard grayscales, to acquire the offset value and the compensation coefficient for the first grayscale.

In the method shown in FIG. 12, the first grayscale is compared with the pre-stored standard grayscales, if there is a standard grayscale being the same as the first grayscale, the compensation value and the compensation coefficient corresponding to the standard grayscale are directly determined as the offset value and the compensation coefficient for the first grayscale; if there is no standard grayscale being the same as the first grayscale, the offset value and the compensation coefficient for the first grayscale are acquired by performing interpolation operation on other grayscales, which can be reduce a measurement time period and data storage amount before the display panel leaves the factory.

Figure 13:
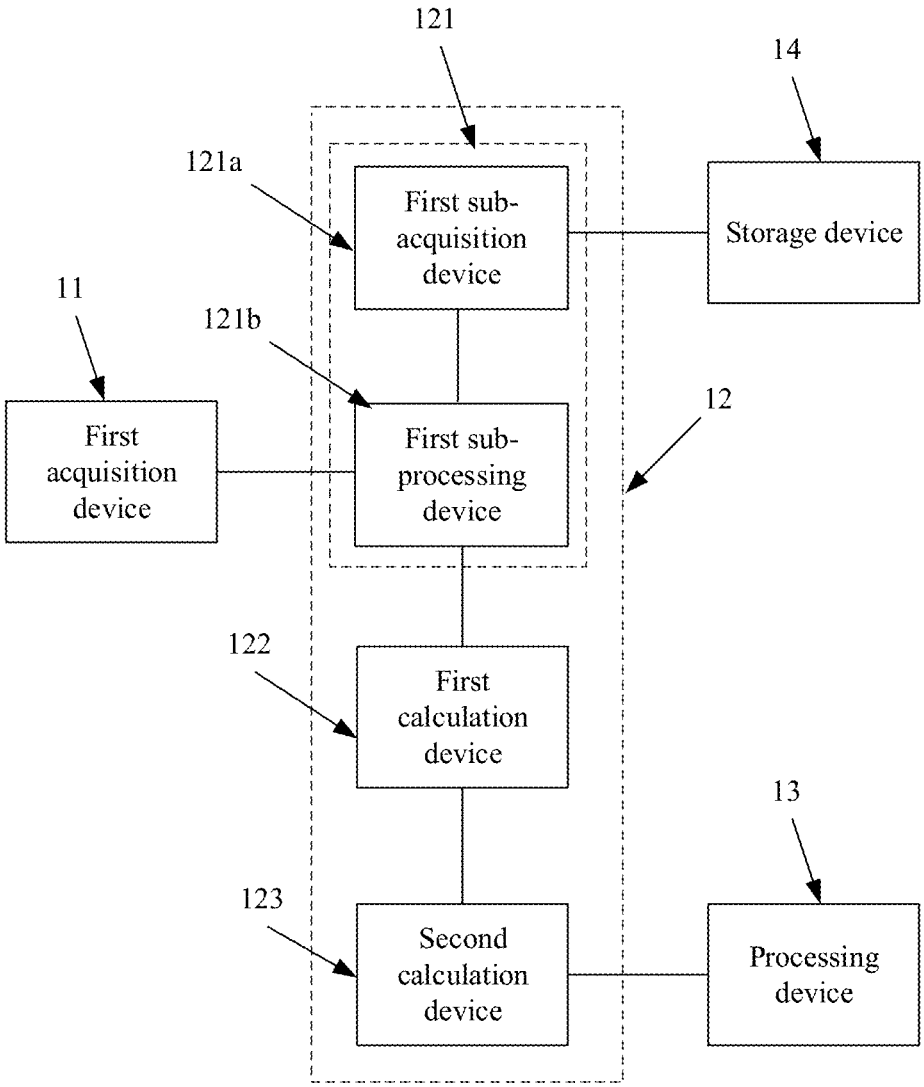
FIG. 13 is a schematic structural drawing of a display driver according to another embodiment of the present disclosure.

Reference is made to FIG. 13, which is a schematic structural drawing of a display driver according to another embodiment of the present disclosure. The display driver further includes a storage device 14. The storage device 14 is configured to pre-store the multiple standard grayscales and the offset value and the compensation coefficient corresponding to each of the multiple standard grayscales. As described above, the multiple standard grayscales, and the offset value and the compensation coefficient corresponding to each of the multiple standard grayscales may be stored in a data table. During the display driving, when the first compensation manner is performed, the multiple standard grayscales, the offset value and the compensation coefficient corresponding to each of multiple standard grayscales that are pre-stored may be directly read, to calculate the compensation value.

Figure 14:
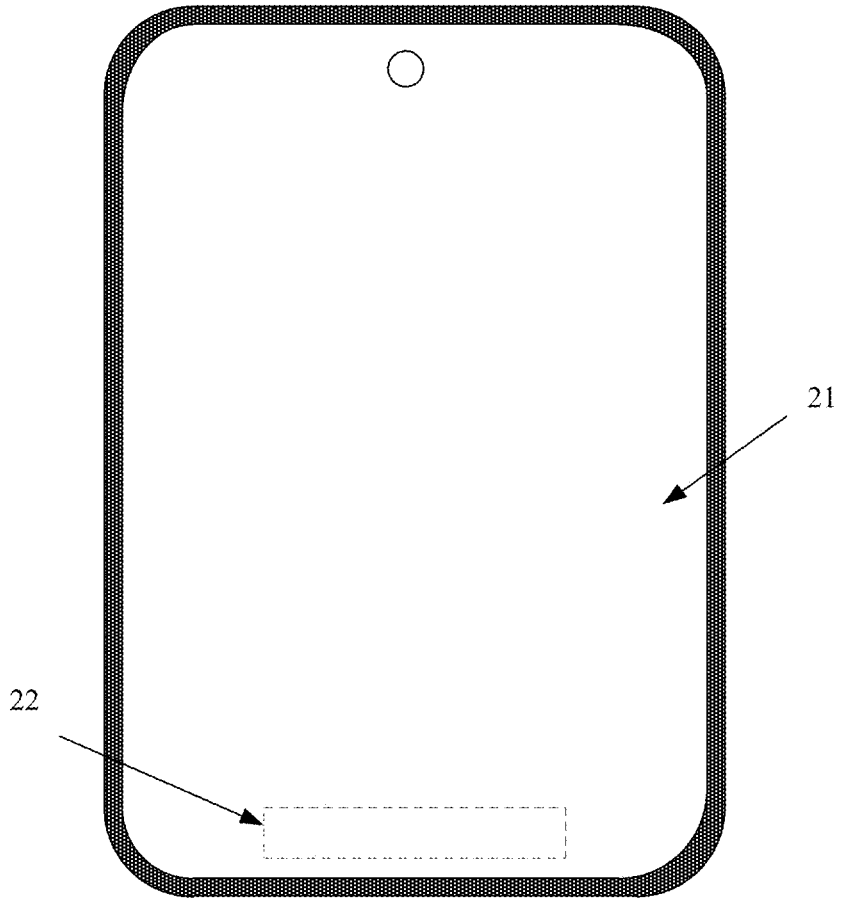
FIG. 14 is a schematic structural drawing of a display device according to an embodiment of the present disclosure.

Based on the above embodiments, a display device is further provided according to another embodiment of the present disclosure, as shown in FIG. 14. FIG. 14 is a schematic structural drawing of a display device according to an embodiment of the present disclosure. The display device includes a display panel 21 and a display driver 22 connected with the display panel 21. The display driver 22 is configured to acquire a first grayscale of at least one to-be-displayed sub-pixel; perform a first compensation manner, to compensate the first grayscale and acquire a second grayscale; determine whether the second grayscale is less than a critical value; perform, if it is determined that the second grayscale is less than the critical value, a second compensation manner to compensate the second grayscale and acquire a third grayscale, and acquire a data voltage based on the third grayscale to control the sub-pixel to emit light and display; and acquire, if it is determined that the second grayscale is greater than or equal to the critical value, a data voltage based on the second grayscale to control the sub-pixel to emit light and display.

In the embodiment of the present disclosure, the display device may be an electronic device having a display function, such as a smart phone, a tablet computer, a notebook computer and an intelligent wearable device. The display driver 22 is the display driver according to the embodiments described above, and may be configured to perform the display driving method described above. In a case that the display panel 21 is controlled to emit light and display, when the display driver 22 performs display compensation on a to-be-displayed first grayscale of a to-be-displayed sub-pixel, a secondary compensation may be performed if a second gray scale acquired by a first compensation manner is less than a critical value, and a third gray scale may be acquired by a second compensation manner, which can solve the problem of displaying color deviation caused by a compensated grayscale located between the 0-grayscale and the minimum calibrated grayscale of the gamma curve in the conventional compensation method in which compensation is performed once.

The embodiments in this specification are described in progressive, in parallel, or in a combination of progressive and parallel, each of which emphasizes the differences from others, and the same or similar parts among the embodiments can be referred to each other. Since the devices disclosed in the embodiment corresponds to the method disclosed in the embodiment, the description for the device is simple, and reference may be made to the method in the embodiment for the relevant parts.

It should be noted that in the description of the present disclosure, it should be understood that the orientation or positional relationship indicated by the terms, such as "upper", "lower", "top", "bottom", "inner", "outer", is based on an orientation or positional relationship shown in the drawings, for the convenience of describing the present disclosure and simplifying the description, rather than indicating or implying that the referred device or element must have a specific orientation, be constructed and operated in a specific orientation.

Therefore, these terms should not be understood as a limitation to the present disclosure. If a component is considered to be "connected" to another component, the component can be directly connected to another component or there may be a component arranged between the two components.

It should further be noted that, the relationship terms such as "first", "second" herein are only to distinguish one entity or operation from another, rather than to necessitate or imply that an actual relationship or order exists between the entities or operations. Furthermore, terms such as "include", "comprise" or any other variations thereof are intended to be non-exclusive. Therefore, an article or device including a series of elements includes not only the elements but also other elements that are not enumerated, or further includes the elements inherent for the article or device. Unless expressively limited, the statement "including a . . . " does not exclude the case that other similar elements may exist in the article or the device other than enumerated elements.

What is claimed is:

1. A display driving method, applied to a display panel, wherein the display driving method comprises:

acquiring a first grayscale of at least one to-be-displayed sub-pixel;

performing a first compensation manner to compensate the first grayscale and acquire a second grayscale;

determining whether the second grayscale is less than a critical value;

performing, if it is determined that the second grayscale is less than the critical value, a second compensation manner to compensate the second grayscale and acquire a third grayscale, and acquiring a data voltage based on the third grayscale to control the sub-pixel to emit light and display; and acquiring, if it is determined that the second grayscale is greater than or equal to the critical value, the data voltage based on the second grayscale to control the sub-pixel to emit light and display.

2. The display driving method according to claim 1, wherein an absolute value of a difference between the third grayscale and the critical value is less than an absolute value of a difference between the critical value and the second grayscale.

3. The display driving method according to claim 1, wherein the performing the second compensation manner comprises:

determining the critical value as the third grayscale.

4. The display driving method according to claim 1, wherein the performing the first compensation manner comprises:

acquiring an offset value and a compensation coefficient for the first grayscale;

calculating a compensation value of the first grayscale based on the offset value and the compensation coefficient for the first grayscale; and calculating the second grayscale based on the compensation value of the first grayscale.

5. The display driving method according to claim 4, wherein the compensation value is equal to a product of the offset value and the compensation coefficient, and the second grayscale is equal to a sum of the first grayscale and the compensation value.

6. The display driving method according to claim 4, wherein the acquiring an offset value and a compensation coefficient for the first grayscale comprises:

determining the offset value and the compensation coefficient for the first grayscale based on a plurality of pre-stored standard grayscales and an offset value and a compensation coefficient corresponding to each of the plurality of standard grayscales.

7. The display driving method according to claim 6, the acquiring an offset value and a compensation coefficient for the first grayscale specifically comprises:

acquiring the plurality of standard grayscales, the offset value and the compensation coefficient corresponding to each of the plurality of standard grayscales;

determining whether there is a standard grayscale being the same as the first grayscale;

determining, if it is determined that there is a standard grayscale being the same as the first grayscale, the standard grayscale being the same as the first grayscale, and determining an offset value and a compensation coefficient corresponding to said standard grayscale as the offset value and the compensation coefficient for the first grayscale; and performing, if it is determined that there is no standard grayscale being the same as the first grayscale, interpolation operation on offset values and compensation coefficients corresponding to at least two of the standard grayscales, to acquire the offset value and the compensation coefficient for the first grayscale.

8. The display driving method according to claim 6, further comprising:

pre-storing the plurality of standard grayscales, and the offset value and the compensation coefficient corresponding to each of the plurality of standard grayscales.

9. A display driver, comprising:

a first acquisition device, wherein the first acquisition device is configured to acquire a first grayscale of at least one to-be-displayed sub-pixel;

a first compensation device, wherein the first compensation device is configured to perform a first compensation manner to compensate the first grayscale and acquire a second grayscale; and a processing device, wherein the processing device is configured to determine whether the second grayscale is less than a critical value; perform, if it is determined that the second grayscale is less than the critical value, a second compensation manner to compensate the second grayscale and acquire a third grayscale, and acquire a data voltage based on the third grayscale to control the sub-pixel to emit light and display; and acquire, if it is determined that the second grayscale is greater than or equal to the critical value, a data voltage based on the second grayscale to control the sub-pixel to emit light and display.

10. The display driver according to claim 9, wherein an absolute value of a difference between the third grayscale and the critical value is less than an absolute value of a difference between the critical value and the second grayscale.

11. The display driver according to claim 9, wherein if the second grayscale is less than the critical value, the processing device is configured to determine the critical value as the third grayscale.

12. The display driver according to claim 9, wherein the first compensation device comprises:

a first acquisition device, wherein the first acquisition device is configured to acquire an offset value and a compensation coefficient for the first grayscale;

a first calculation device, wherein the first calculation device is configured to calculate a compensation value of the first grayscale based on the offset value and the compensation coefficient for the first grayscale; and a second calculation device, where the second calculation device is configured to calculate the second grayscale based on the compensation value of the first grayscale.

13. The display driver according to claim 12, wherein the first calculation device is configured to calculate a product of the offset value and the compensation coefficient, and determine the product as the compensation value; and the second calculation device is configured to calculate a sum of the first grayscale and the compensation value, and determine the sum as the second grayscale.

14. The display driver according to claim 12, wherein the first acquisition device is configured to determine the offset value and the compensation coefficient for the first grayscale based on a plurality of pre-stored standard grayscales and an offset value and a compensation coefficient corresponding to each of the plurality of standard grayscales.

15. The display driver according to claim 12, wherein the first acquisition device comprises:

a first sub-acquisition device, wherein the first sub-acquisition device is configured to acquire the plurality of standard grayscales, the offset value and the compensation coefficient corresponding to each of the plurality of standard grayscales; and a first sub-processing device, wherein the first sub-processing device is configured to determine whether there is a standard grayscale being the same as the first grayscale; determine, if it is determined that there is a standard grayscale being the same as the first grayscale, the standard grayscale being the same as the first grayscale, and determine an offset value and a compensation coefficient corresponding to said standard grayscale as the offset value and the compensation coefficient for the first grayscale; and perform, if it is determined that there is no standard grayscale being the same as the first grayscale, interpolation operation on offset values and compensation coefficients corresponding to at least two of the standard grayscales, to acquire the offset value and the compensation coefficient for the first grayscale.

16. The display driver according to claim 14, further comprising:

a storage device, wherein the storage device is configured to pre-store the plurality of standard grayscales and the offset value and the compensation coefficient corresponding to each multiple standard grayscales.

17. A display device, comprising:

a display panel; and a display driver connected with the display panel, wherein the display driver is configured to:

acquire a first grayscale of at least one to-be-displayed sub-pixel;

perform a first compensation manner, to compensate the first grayscale and acquire a second grayscale;

determine whether the second grayscale is less than a critical value;

perform, if it is determined that the second grayscale is less than the critical value, a second compensation manner to compensate the second grayscale and acquire a third grayscale, and acquire a data voltage based on the third grayscale to control the sub-pixel to emit light and display; and acquire, if it is determined that the second grayscale is greater than or equal to the critical value, a data voltage based on the second grayscale to control the sub-pixel to emit light and display.

* * * * *